US006107607A

United States Patent [19]

Jablonski

[11] Patent Number: 6,107,607

[45] Date of Patent: Aug. 22, 2000

[54] HEATED DRIPTRAY

[75] Inventor: Thaddeus M. Jablonski, Pallatine, Ill.

[73] Assignee: IMI Cornelius Inc., Anoka, Minn.

[21] Appl. No.: 09/076,157

[22] Filed: May 11, 1998

[51] Int. Cl.[7] ..... H05B 3/06; F25C 5/08; F25C 5/16

[52] U.S. Cl. ..... 219/441; 219/385; 219/214; 219/438; 222/146.5

[58] Field of Search ..... 219/214, 438, 219/441, 385, 386; 222/146.5

[56] References Cited

U.S. PATENT DOCUMENTS

| | | | |
|---|---|---|---|
| 3,633,374 | 1/1972 | Canter | 219/505 |
| 4,822,981 | 4/1989 | Chaudoir | 219/385 |
| 5,010,741 | 4/1991 | Gelatini | 62/246 |
| 5,015,824 | 5/1991 | Monter et al. . | |
| 5,526,854 | 6/1996 | Unger | 222/146.5 |
| 5,582,754 | 12/1996 | Smith et al. | 219/438 |

FOREIGN PATENT DOCUMENTS

| | | |
|---|---|---|
| 2336174 | 2/1974 | Germany . |

*Primary Examiner*—Joseph Pelham
*Attorney, Agent, or Firm*—Sten Erik Hakanson

[57] ABSTRACT

The present invention relates to drinks dispense equipment having an ice dispensing capability. A drip tray is secured to such a dispenser and the drip tray has an electrical heating element secured directly to a bottom surface thereof. The heating element consists of a specialized printed circuit having a flexible plastic base having a positive temperature coefficient (PTC) electrical heating element printed on one surface thereof. The PTC element's resistance to the flow of electrical current decreases as its temperature decreases. Thus, the cooler the circuit the more current is allowed to flow there through, whereas the warmer the circuit the less current flows through the heating element thereof. In operation, as ice accumulates on the drip tray, the heating element is cooled causing an increase in the heat output thereof, thereby melting the ice. Once the ice has melted the heating element will reduce the flow of current as the temperature thereof warms to ambient. The present invention also comprises a similar PTC based flexible heating circuit for securing to a gear motor of an ice dispensing machine. In a similar manner, the gear motor is heated by operation of the heating strip. This heating prevents the gear motor from cooling to a temperature below the ambient dewpoint as a result of conductive cooling from the ice retaining bin of the dispenser. Thus, unwanted water condensation on the gear motor is prevented.

1 Claim, 4 Drawing Sheets

10
12
14
14
16
18
24
24
26
20
30

20
22
22
28
34
32a
30
32b
32
46
48
42
40

20
30
46
46
48
48
44
42
40

HEATED DRIPTRAY

FIELD OF THE INVENTION

The present invention relates generally to beverage dispensing equipment, and more specifically to such equipment having a cup rest/driptray.

BACKGROUND OF THE INVENTION

Fountain beverage dispensing equipment is well known in the art and is often designed to dispense both beverage drinks and ice. Typically, several individual dispensing valves and a single ice dispense chute are positioned on the dispenser above a drip tray. The drip tray serves as a platform on which a receptacle, such as a cup, can be placed as it is being filled. The drip tray support surface or cup rest generally comprises a wire grate with spacing between the wires of the grate allow any spilled beverage to flow there between to a drain located there below.

Since a cup is often held during dispensing, and particularly when being filled with ice, the cup rest is not as necessary in the area directly below the ice dispensing chute. Thus, the grate wire spacing can be increased or eliminated to permit any spilled ice particles to fall directly into the driptray and not build up directly on the surface of the cup rest. Under many conditions the inherent volume of the driptray below the cup rest can accommodate enough ice such that buildup thereof above the level of the cup rest is not a problem. However, during periods of high use, sufficient ice can spill in excess of its melt rate such that a significant volume thereof can then accumulate in the tray. A build up of ice in this manner can interfere with the physical placement of a cup below the ice dispensing chute, and will eventually lead to ice falling from the driptray onto the floor area surrounding the dispenser. Thus, in addition to making use more difficult, drip tray ice build up can result in the floor area around the dispenser becoming wet and having particles of ice thereon, which presents cleanliness and safety hazard problems.

Conventional heating elements can be used to melt accumulated driptray ice, however the cost thereof can be prohibitive if separate temperature sensing and control means are used to maintain and operate the heating element within a predetermined temperature range. Where no controls are used, the heating element simply runs continuously, thus wasting power when heating is not required. Also, should a control mechanism fail, such heaters can reach temperatures well above what would be practical or safe for standard plastic drip trays. Accordingly, it would be desirable to have a way of eliminating or minimizing such ice build up problems in a manner that is safe, reliable and of low cost.

In ice and beverage dispensing machines of the above described type, an electrical drive motor is used to rotate an ice stirring auger and associated ice lifting mechanism. This mechanism is located in the ice storage bin, and is rotated to maintain the ice cubes in a free flowing individual state and to direct the ice to the ice dispensing chute when dispensing therefrom is required. The ice moving and lifting mechanism is typically driven by a gear motor consisting of an electrical drive motor secured to a reduction drive gear box. This drive unit is secured to the bin and includes a metal shaft that extends into the bin and is ultimately connected to the ice stirring and dispensing mechanism. A problem with the motor and gearbox assembly concerns the conductive cooling thereof through the shaft and by close contact thereof with the bin. This cooling can reach a temperature well below the ambient dewpoint resulting in unwanted water condensation on the motor and gearbox. This condensation can drip there from resulting in corrosion and electrical conductivity problems with other internal components of the dispenser, as well as the drive unit itself.

Conventional heating elements are used, but run continuously thereby consuming more electrical power than is required, particularly during times that the drive is operating and sufficiently warm. Accordingly, it would also be desirable to have a way of eliminating or minimizing such condensation problems in a manner that is safe, reliable and low in cost.

SUMMARY OF THE INVENTION.

The present invention comprises a driptray having a positive temperature coefficient (PTC) material based heater secured directly to a bottom surface thereof. As is known in the art, such heaters are comprised of a flexible plastic circuit board having the PTC material printed on one side thereof and an adhesive covering the other side. PTC material, as is understood, is unique in that the electrical conductivity thereof is inversely proportional to its temperature, or stated another way, as the temperature thereof increases, its resistance increases. Thus, as the PTC material cools, the conductivity thereof increases as its resistance decreases, and more current is allowed to flow there through so that heat is produced. Conversely, as the PTC material warms, the conductivity thereof decreases, resistance increases, and less current is allowed to flow there through whereby less heat is produced.

In operation, as ice accumulates on the drip tray, the PTC material adjacent the underside thereof is cooled causing an increase in current flow there through and a resultant increase in the heat output thereof. Once the ice has melted, warming of the PTC material results in a reduction of the flow of current there through and a corresponding reduction in the its heat output. A major advantage of the present invention is that the PTC material operates in a self regulating manner thereby eliminating the need for a separate temperature control mechanism. Moreover, as is known in the art, the temperature effect is localized to that portion of the PTC heating circuit experiencing a temperature change. Thus, for example, if an ice cube is sitting on the driptray, additional heating will occur in the vicinity of that cube, whereas the remainder of the surface area of the PTC material circuit will remain less active. In this manner energy is conserved, as opposed to conventional heating elements that would heat at the same rate along their entire length and heat all of the driptray surface area uniformly. Also, the increase in resistance of the PTC material as it warms provides for an automatic safety mechanism for preventing too much current draw and over heating. There is also a safety advantage in that the temperature operating range of the PTC material can be selected so that no heat damage to the driptray, typically made of plastic, will occur.

The present invention also comprises a motor and gearbox for use in an environment wherein cooling thereof normally occurs to a temperature well below the ambient dewpoint. A circuit board comprises an elongate strip of flexible plastic circuit board having a PTC material circuit printed on one surface thereof and an adhesive on the opposite side thereto. A portion of both ends of the circuit board have only adhesive on one side and no PTC material opposite therefrom. A pair of quick connect electrical contacts are secured to the flexible strip at a position thereon along the elongate edges thereof.

In operation, the heating strip is of sufficient length to be wrapped around the circumference of the gearbox so that the portions of the strip that do not contain the PTC material overlap each other. Thus, the strip can be adhered to itself with the overlapping portions and is also adhered to the drive unit. The heating strip is then connected to a suitable electrical power source. As the drive mechanism cools, the PTC material cools causing an increase of electrical flow there through and a concomitant greater heat output for heating the drive mechanism above the dewpoint temperature, thereby preventing condensation thereon. Conversely, as the temperature of the drive rises, the PTC material warms and automatically conducts less and does not serve to provide heating thereof. Thus, the PTC heating strip, as described above, is self regulating and, in this embodiment, serves to prevent condensation on the drive mechanism and wasteful heating when it is not needed.

DESCRIPTION OF THE DRAWINGS

A better understanding of the structure, function, operation, objects and advantages of the present invention can be had by reference to the following detailed description which refers to the following figures, wherein.

DETAILED DESCRIPTION OF THE PREFERRED EMBODIMENTS

Figure 1:
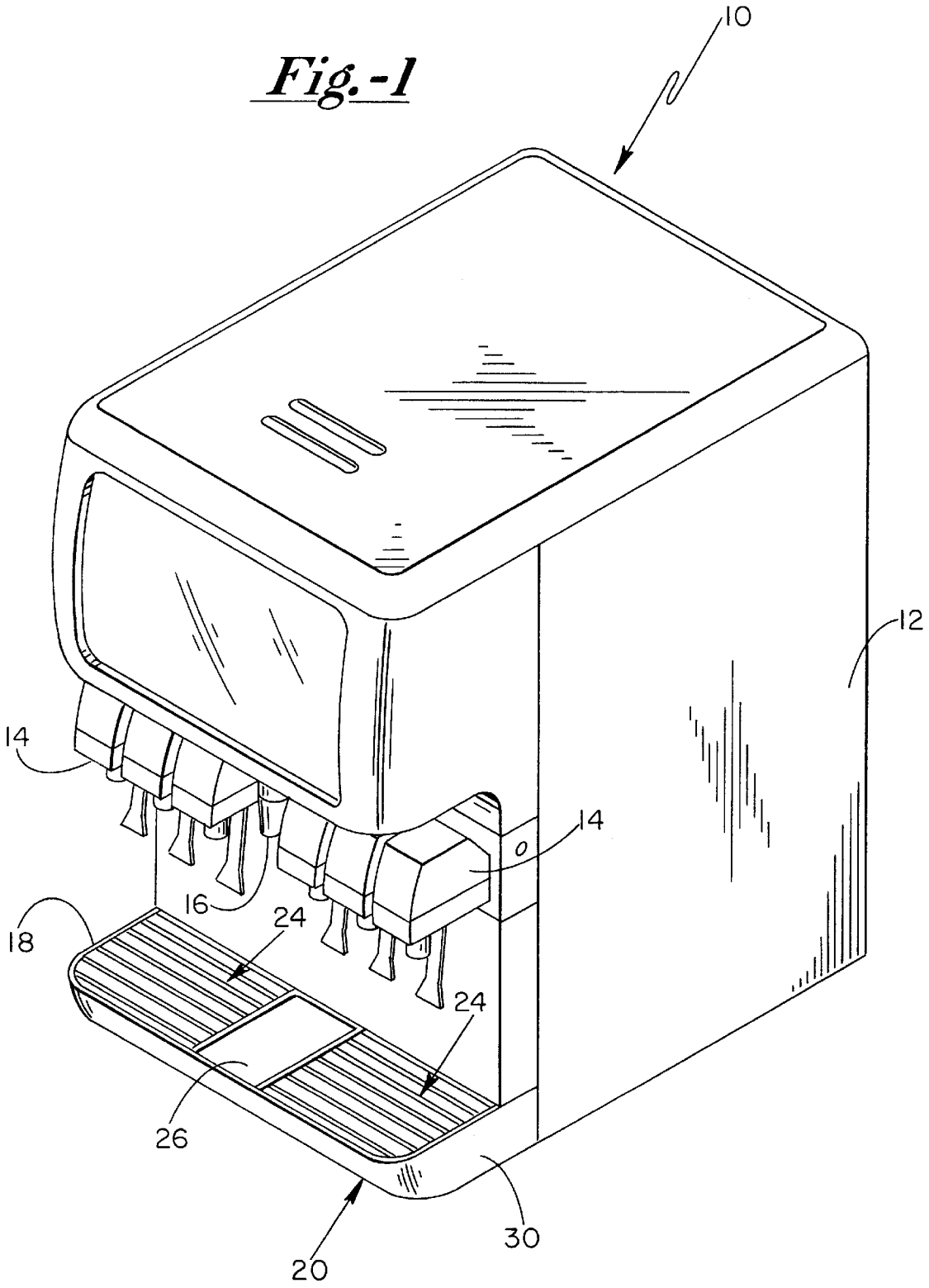
FIG. 1 shows a perspective view of a combined ice and beverage dispenser.
Figure 2:
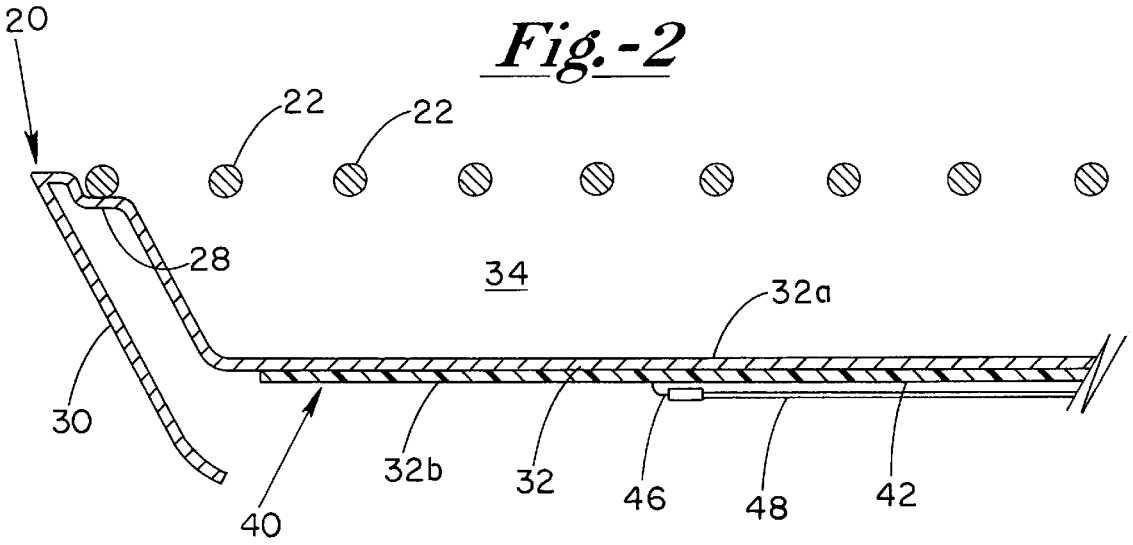
FIG. 2 shows an enlarged side plan cross sectional view of the driptray of the present invention.

A combined beverage/ice dispenser is seen in FIG. 1 and generally referred to by the numeral 10. Dispenser 10 includes a housing 12 and provides for support of a plurality of beverage dispensing valves 14 thereon along, and also includes an ice dispensing chute 16. Directly beneath valve 14 and chute 16 is a wire cup rest grate 18 supported on a driptray 20. As seen by also referring to FIG. 2, cup rest 18 includes a plurality of rigid wires 22. The pattern of the wires 22 serve to define cup rest areas 24 and an ice opening 26.

As is understood in the art, driptray 20 is molded from a rigid plastic and includes a perimeter shelf edge 28 for support of cup rest 18. Driptray 20 also includes side walls 30 and a bottom end 32 defining an interior volume 34 thereof. Bottom end 32 includes a top surface 32*a* and a bottom surface 32*b*. Driptray bottom end 32 is inclined in a direction towards a drain hole, (not shown) therein.

Figure 3:
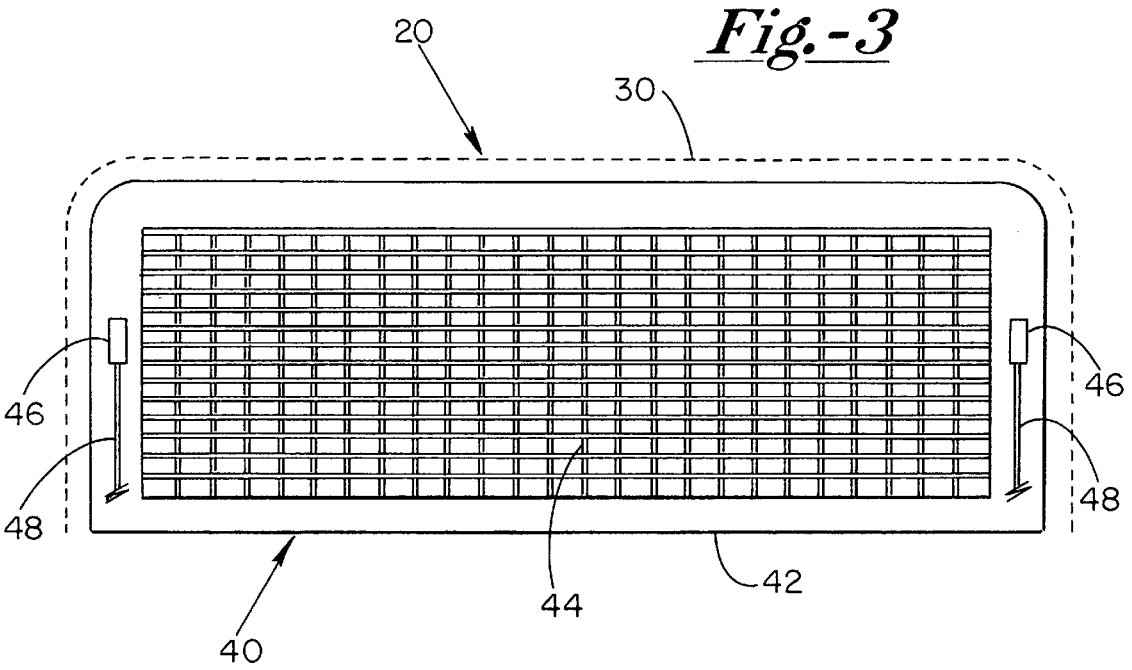
FIG. 3 shows a bottom plan view of the driptray heater.

As seen by also referring to FIG. 3, a PTC material based heater 40 is secured to the exterior surface of driptray bottom end 32. Heater 40 comprises a flexible plastic circuit board 42 having a PTC material heating circuit 44 printed on one surface 42*a* thereof. An adhesive material is coated on the opposite side 42*b* thereof. Circuit board 40 has a surface area substantially equivalent to that of driptray bottom surface 32*b*. Heating circuit 40 includes two quick connect contacts 46 for providing connection by a pair of wires 48 to a 24 volt AC power source, not shown. Heater 40 is of the type as, for example, manufactured by ITW Chronotherm of Elmhurst, Ill. Heater 40 is first adhered to surface 32*b* after which driptray 20 is installed in dispenser 12 and heater 40 is connected to a suitable source of power. In operation, once any ice falls on surface 32*a* and is retained in area 34, the cooling caused thereby results in a decreased electrical resistance of PTC material 44 of heater 40. The decreased resistance causes more current to flow and a resultant increased heating, which in turn serves to melt the ice. Once all the ice is melted, circuit 44 warms up and the electrical resistance thereof increases, thereby reducing the heat output thereof. As is understood by those of skill, an equilibrium temperature will be reached for a given ambient temperature. The PTC material and heater is selected and designed to stabilize at a temperature of approximately 160 degrees Fahrenheit with a resultant driptray temperature of approximately 120 degrees F. These temperatures are well below that which would cause damage to driptray 20. Moreover, the self limiting nature of PTC material with respect to increased resistance as it heats, will insure against any excessive current draw. Also, the steady state current draw is minimal and does not result in excessive energy consumption. Thus, the present invention provides for a cost effective means of heating and one that is very safe. Furthermore, the self regulating ability of the PTC material 44 eliminates the need and cost of a separate temperature control mechanism. It will be appreciated by those of skill that the heated driptray of the present invention could also be used in the context of a dispenser that only dispenses ice.

Figure 4:
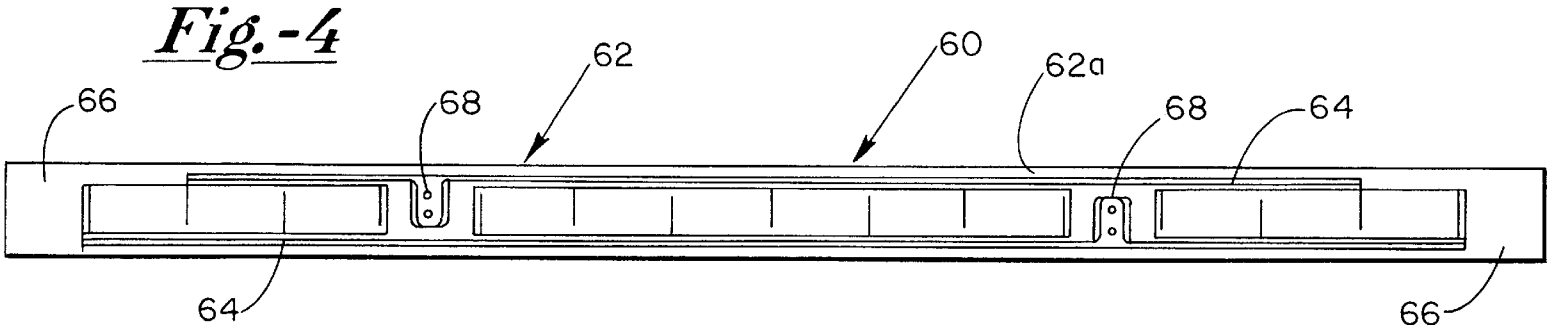
FIG. 4 shows a top plan view of the PTC heating strip.
Figure 5:
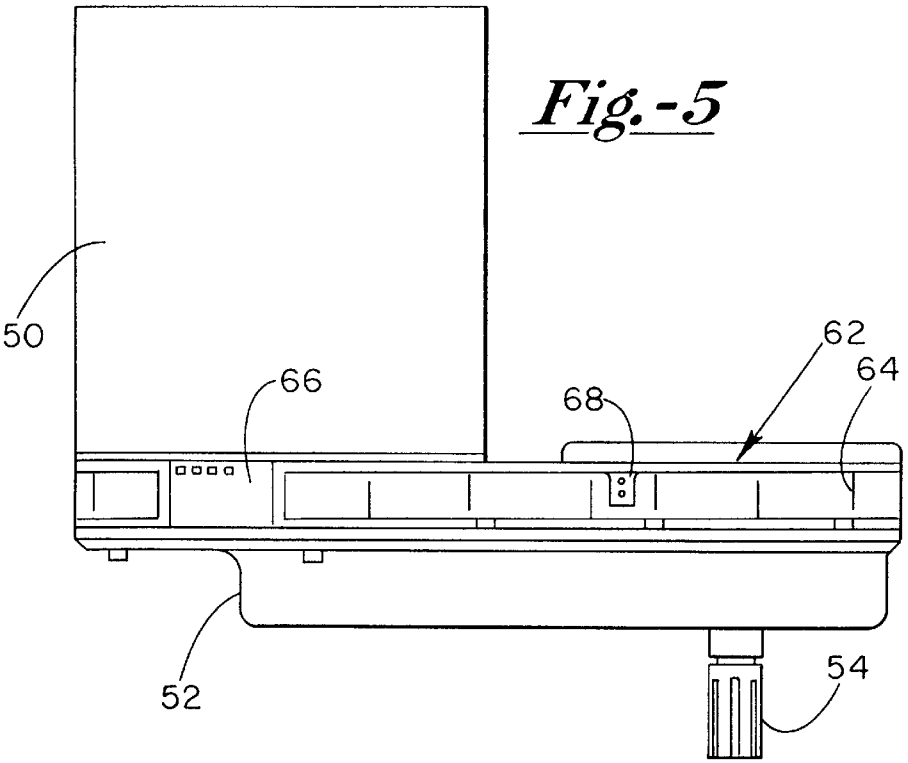
FIG. 5 shows side plan view of the a drive mechanism having the PTC heating strip secured thereto.
Figure 6:
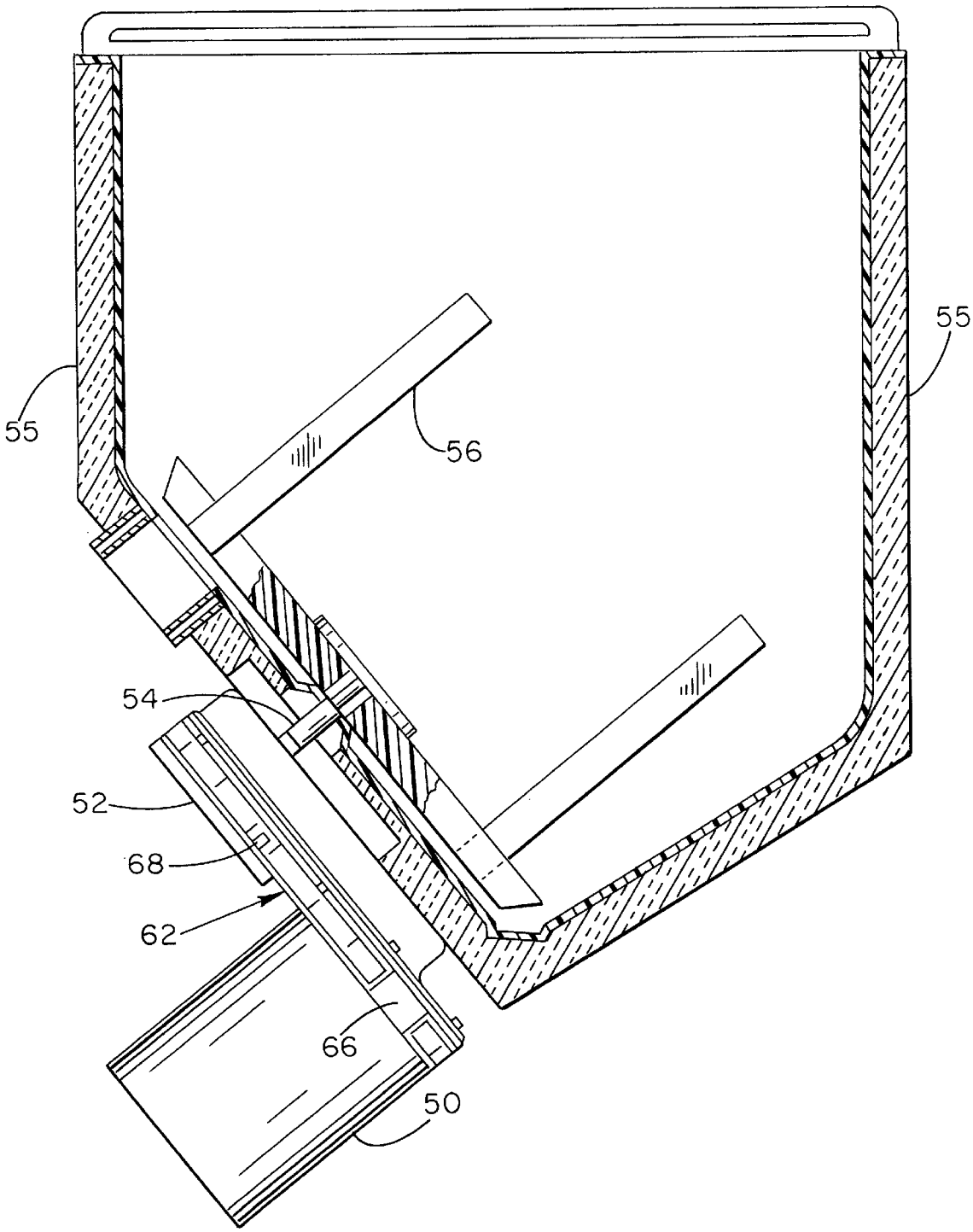
FIG. 6 shows a drive mechanism of FIG. 5 secured to an ice bin.

As seen by referring to FIGS. 4–6, a drive mechanism is comprised of a motor 50 secured to a reduction drive gearbox 52. Gearbox 52 is secured to an ice retaining bin 53, and includes a shaft 54 that extends from gearbox 52 and is connected to an ice auger/ice dispensing mechanism 56. As is known in the art, motor 50 is used to rotate mechanism 56, such rotation speed and power being modified by gearbox 52.

A PTC heating strip 60 is seen in FIG. 4, and includes a flexible printed circuit board 62 having one side 62*a* on which is printed a PTC material circuit 64 and an opposite side having an adhesive thereon. Flexible board 62 includes two end portions 66 thereof over which no PTC material is printed but which have adhesive on the corresponding opposite ends thereof. A pair of quick connect electrical contacts are secured to board 68 along elongate edges thereof.

As seen in FIG. 5, strip 60 is secured to an outer perimeter of gearbox 52 whereby the adhesive surface thereof provides for securing thereto. It can also be appreciated that strip 60 is of sufficient length that the portions 66 overlap each other whereby strip 60 can be adhered to itself as well as to gearbox 52, thereby providing for an additionally secure attachment thereto. Wires, connected to a suitable source of electrical power, not shown, are connected to contacts 68.

In operation, as gearbox 62 cools as the result of conductive contact with ice bin 53 and, in turn, the ice therein, the conductivity of the PTC material 64 of strip 60 increases and heats gearbox 52, and by conduction, motor 50. Conversely, as motor 50 and gearbox 52 are heated, the conductivity of the PTC material 64 is reduced thereby reducing heat output.

Thus, heating strip 60 automatically self regulates the temperature of motor 50 and gearbox 52 to be above the ambient dewpoint thereby eliminating condensation thereon. Having the contacts 48 positioned along the elongate edges of strip heater 60 makes for a more rugged structure. Thus, for example, any torque on contacts 48 that may result from disconnecting the wires secured thereto, has less tendency to result in any damage to the plastic circuit board 62.

In a particular embodiment of the present invention, strip 60 is approximately 0.75 inch wide and approximately 14 inches long and is used in conjunction with a 1/10 horsepower as manufactured by ECM Motor Company, Elkhorn Wis. The power supply used in this example is 115VAC. The PTC material and heater are selected and designed to maintain temperatures above the ambient dewpoint temperature, thus typically at approximately 70 degrees Fahrenheit. Using the 115VDC line voltage has the advantage of not requiring a transformer. Thus, the heating strip 60 can be wired directly to the power supplied to the motor 50. However, those of skill will understand that the PTC circuit can be configured to be useful with other power supplies, such as 12 or 24 volts, which would require the use of a transformer.

In the claims:

1. A heated driptray for use in a dispenser of the type capable of dispensing ice from an ice dispensing point, comprising:

a driptray positioned below the ice dispensing point, the driptray having a bottom exterior surface, the driptray bottom exterior surface having a PTC based heater secured thereto, the PTC based heater including a flexible circuit board having a PTC heating element on one side thereof and contacts for connecting to a source of electrical power and an opposite side of the circuit board for securing thereof to the bottom exterior surface of the driptray.

* * * * *